US005546783A

United States Patent [19]

Fischer et al.

[11] Patent Number: 5,546,783

[45] Date of Patent: Aug. 20, 1996

[54] CRIMP SEALING OF TUBES FLUSH WITH OR BELOW A FIXED SURFACE

[75] Inventors: Jon E. Fischer, Concord; Don Walmsley; P. Derek Wapman, both of Livermore, all of Calif.

[73] Assignee: The United States of America as represented by the United States Department of Energy, Washington, D.C.

[21] Appl. No.: 251,421

[22] Filed: May 31, 1994

[51] Int. Cl.[6] ..... B21D 28/00

[52] U.S. Cl. ..... 72/325; 72/412; 137/15; 29/890.14; 220/362

[58] Field of Search ..... 72/325, 338, 367, 72/412, 324; 29/890.14; 219/59.1; 137/15; 251/4, 5; 220/362, 363

[56] References Cited

U.S. PATENT DOCUMENTS

| | | | |
|---|---|---|---|
| 2,414,178 | 1/1947 | Sprinkle | 72/412 |
| 2,427,507 | 9/1947 | Garner et al. | 226/20.2 |
| 2,435,294 | 2/1948 | Schwinn | 72/412 |
| 2,776,473 | 1/1957 | Dailey et al. | 29/475 |
| 3,078,904 | 2/1963 | Bishop | 72/412 |
| 3,251,525 | 5/1966 | Zietz | 228/13 |
| 3,260,098 | 7/1966 | Gill | 72/416 |
| 3,263,465 | 8/1966 | Way | 72/48 |
| 3,266,287 | 8/1966 | Gill | 72/416 |
| 3,334,407 | 8/1967 | DeSantis | 29/412 |
| 3,505,556 | 4/1970 | Belknap | 313/318 |
| 3,517,907 | 6/1970 | Bach | 29/890.14 |
| 4,287,746 | 9/1981 | Thompson | 72/338 |
| 4,512,488 | 4/1985 | Schwenk . | |
| 4,727,233 | 2/1988 | Pavese et al. | 219/121 |

FOREIGN PATENT DOCUMENTS

| | | | |
|---|---|---|---|
| 6737 | 1/1981 | Japan | 72/324 |
| 239974 | 9/1925 | United Kingdom | 72/324 |

OTHER PUBLICATIONS

J. E. Fischer, "Crimp Sealing Of Tubes Flush Or Below A Fixed Surface".

*Primary Examiner*—Daniel C. Crane
*Attorney, Agent, or Firm*—John P. Wooldridge; William C. Daubenspeck; William R. Moser

[57] ABSTRACT

An apparatus for crimp sealing and severing tubes flush or below a fixed surface. Tube crimping below a fixed surface requires an asymmetric die and anvil configuration. The anvil must be flat so that, after crimping, it may be removed without deforming the crimped tubes. This asymmetric die and anvil is used when a ductile metal tube and valve assembly are attached to a pressure vessel which has a fixed surface around the base of the tube at the pressure vessel. A flat anvil is placed against the tube. Die guides are placed against the tube on a side opposite the anvil. A pinch-off die is inserted into the die guides against the tube. Adequate clearance for inserting the die and anvil around the tube is needed below the fixed surface. The anvil must be flat so that, after crimping, it may be removed without deforming the crimped tubes.

8 Claims, 5 Drawing Sheets

CRIMP SEALING OF TUBES FLUSH WITH OR BELOW A FIXED SURFACE

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the use of cold-weld pinch-off devices to close pressure vessels. More specifically, it relates to crimp sealing of tubes flush or below a fixed surface to achieve a leak tight seal.

2. Description of Related Art

A need exists in vacuum and pressure systems to close pressure vessels with a leak tight seal. Metal seals are often preferred over elastomeric seals such as o-rings, due to the high reliability and resistance to hostile environments that can be achieved with metal seals.

One method of closing a vessel (FIG. 1) with a metal seal is to have a small ductile metal tube 2 attached to the vessel 4. FIG. 2 shows how tube 2 may be pinched and severed by a crimping tool 6. This technique offers some advantages over welding or brazing such as reduced risk of exposure to the vessel contents and no need for large amounts of thermal energy input to the vessel. Furthermore, tube crimping is sometimes preferred over using gaskets, flanges, valves and fittings because of the reduced bulk and weight that results.

One disadvantage of crimp sealing tubes is the remnant of the crimped tube itself which is left protruding from the vessel. The tube remnant may be very sharp and pose a hazard to people and it may be delicate and require some type of protection to avoid reopening the vessel.

U.S. Pat. No. 4,727,233 is directed to a method for sealing tubes that includes the steps of locally compressing the portion of the tube to be sealed with a pressure capable of achieving a seal, clamping of the tube, cutting the compressed portion of the tube, welding the lips of the part which is still clamped, and finally removing the damping pressure. U.S. Pat. No. 4,512,488 is directed to a method for sealing oval shaped tubing using crimping with severing. U.S. Pat. No. 4,287,746 discloses a device for crimping and severing capillary tubes using cold welding. U.S. Pat. No. 3,505,556 is directed to a symmetric pinch-off crimp for incandescent lamps with a filament sealed into the crimp. U.S. Pat. No. 3,251,525 is directed to an apparatus for sealing tubulations by pinching off and cold weld sealing the tubulation using pinch jaws.

U.S. Pat. No. 3,334,407 is directed to a method for making a rupturable fluid bearing container by crimping a metal tube with pinch-off dies. U.S. Pat. No. 3,263,465 is directed to an apparatus for severing and sealing a hollow conduit, resulting in a symmetric seal. U.S. Pat. No. 2,776,473 is directed to a method of tube sealing by pinching off and sealing using crimping jaws. U.S. Pat. No. 2,427,597 is directed to a method for cold weld sealing of tubes using symmetric crimp dies. U.S. Pat. No. 3,266,287 discloses an apparatus for closing and reopening a metal tube. Symmetric crimping is employed. U.S. Pat. No. 3,260,098 is directed to a crimping tool for closing and reopening a metal tube.

Conventional tube crimping is typically done with tools that satisfy these requirements:

a. A symmetric pair of dies made of hardened tool steel are needed. Frequently these dies are made to very precise machining tolerances and the die shape is customized for a particular application.

b. A mechanism is needed to guide and align the dies while a very large force concentration is applied. This may be achieved by installing the dies into a block with a screw driven arrangement, or a lever mechanism similar to those used for bolt cutters may be used.

c. Dies must be retractable for disassembly.

For a conventional symmetric tube crimping configuration, the tube is crimped above a fixed surface on a pressure vessel. An equal force is exerted on symmetric dies, both having blunt tips This angle results in large components of shear and tensile stress in sections of the tube which would be in nearly pure compression if a conventional crimping device was used. The shear stress improves the quality of the seal. However, the tensile stress causes stretching in the portion of the tube that is to be removed if the tube is not allowed to move with the die. If the tube stretches, it will have a reduction in cross sectional area which results in a reduction of the amount of compression on the tube.

SUMMARY OF THE INVENTION

The present invention is an apparatus for crimp sealing and severing tubes flush with or below a fixed surface. Tube crimping below a fixed surface requires a die and anvil configuration that is not symmetric. This invention is used When a ductile metal tube and valve assembly are attached to a pressure vessel which has a fixed surface around the base of the tube at the pressure vessel. A flat anvil is placed against the tube. Die guides are placed against the tube on a side opposite the anvil. A pinch-off die is inserted into the die guides against the tube. Adequate clearance for inserting the die and anvil around the tube is needed below the fixed surface. The anvil must be flat so that, after crimping, it may be removed without deforming the crimped tubes.

FIG. **5*a*** shows a conventional symmetric tube crimping configuration.

FIG. **5*b*** is a die and anvil configuration for one embodiment of the invention.

Figure 6:
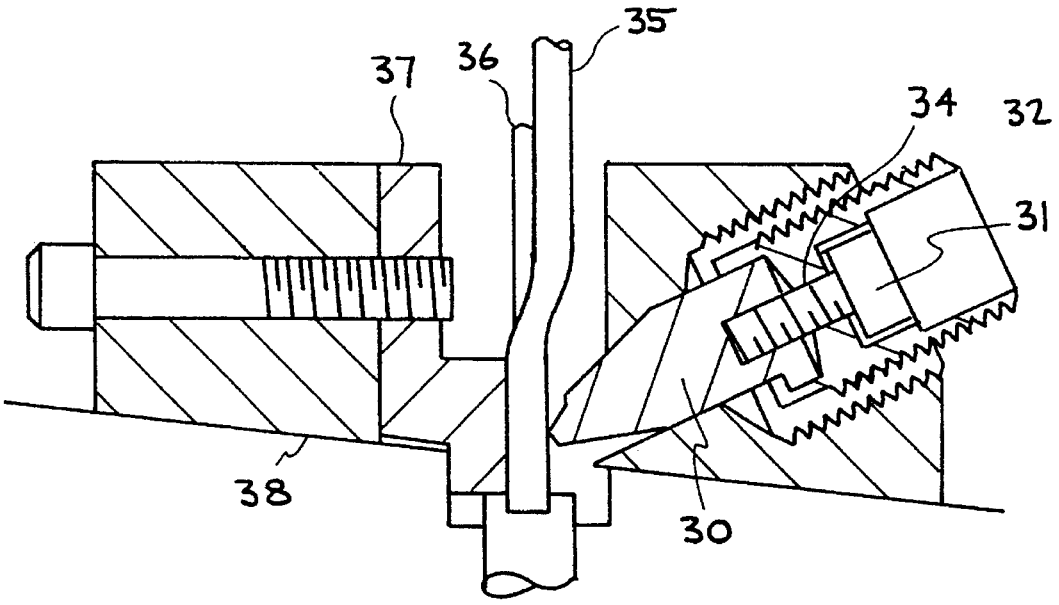

FIG. 6 shows a double tube crimp with a screw drive mechanism.

Figure 7:
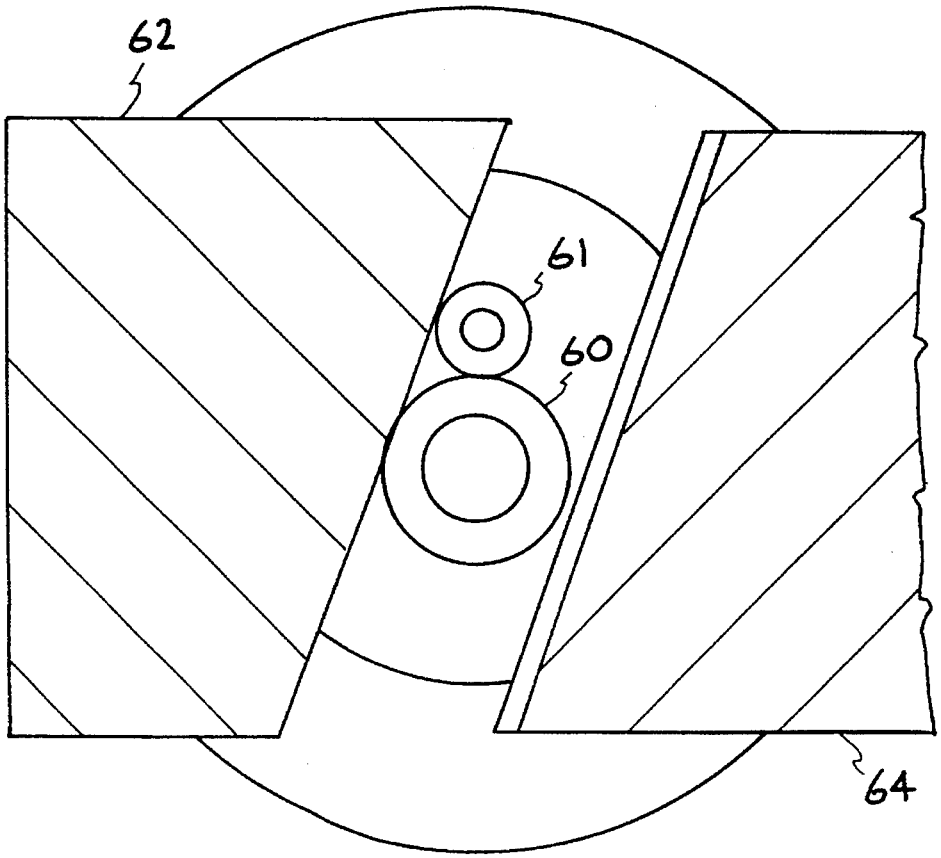

FIG. 7 shows a double tube crimp.

DETAILED DESCRIPTION OF THE INVENTION

Figure 2:
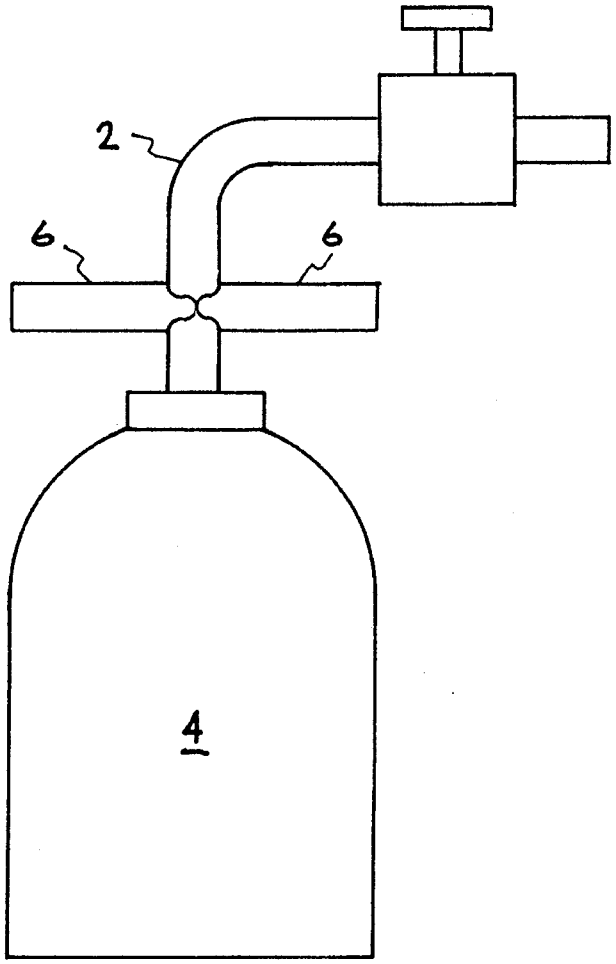
FIG. 2 (PRIOR ART)
FIG. 2 shows a vessel crimped with conventional crimp dies.
Figure 1:
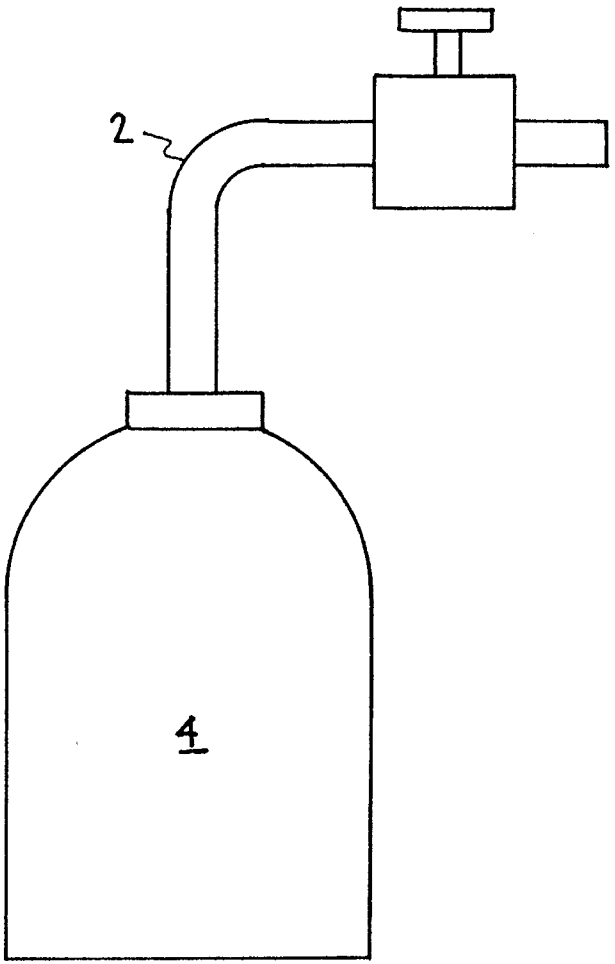
FIG. 1 (PRIOR ART)
FIG. 1 shows a tube attached to pressure a pressure vessel.
Figure 3:
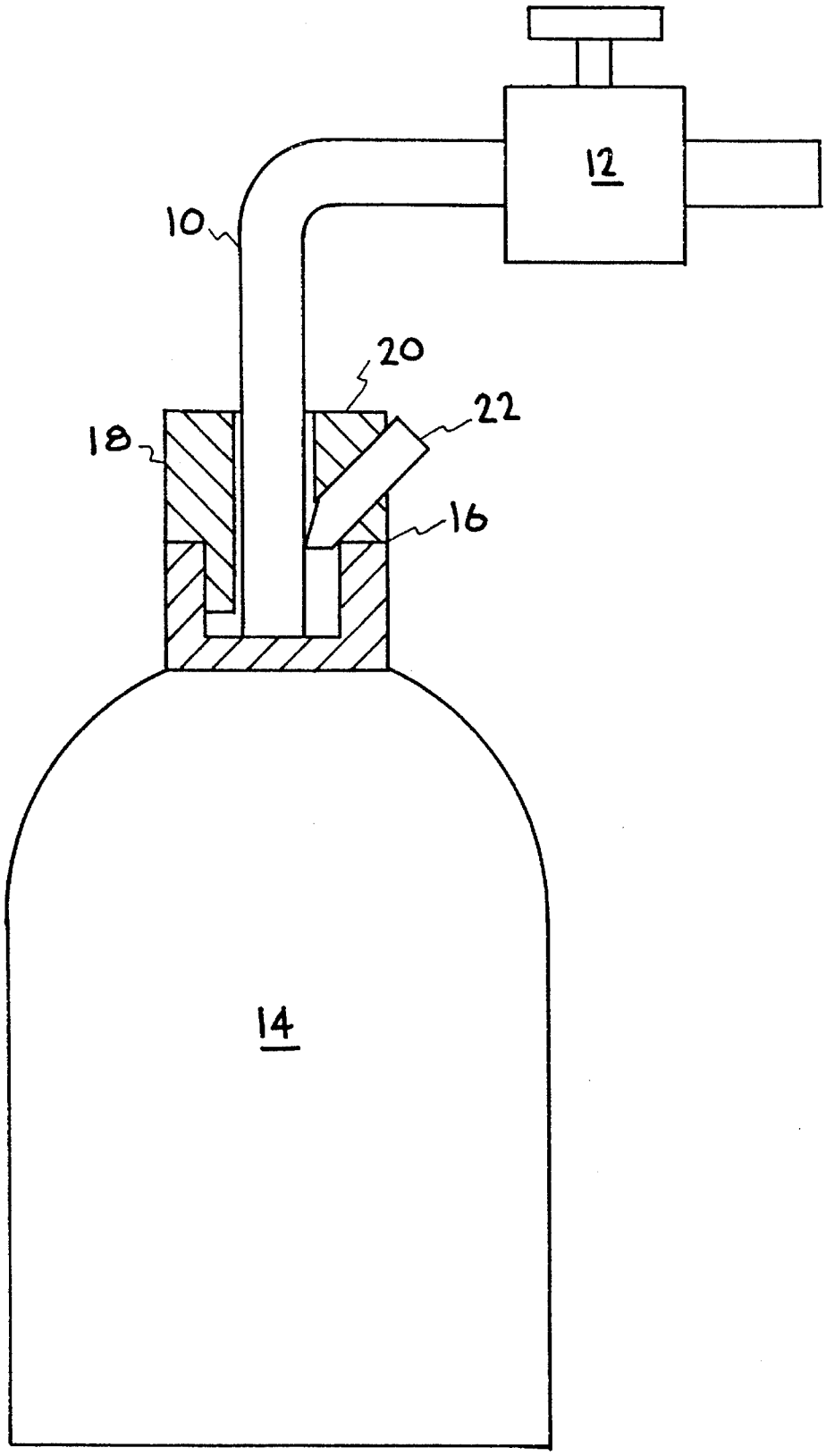
FIG. 3 shows a die and anvil configuration for one embodiment of the invention.
Figure 4:
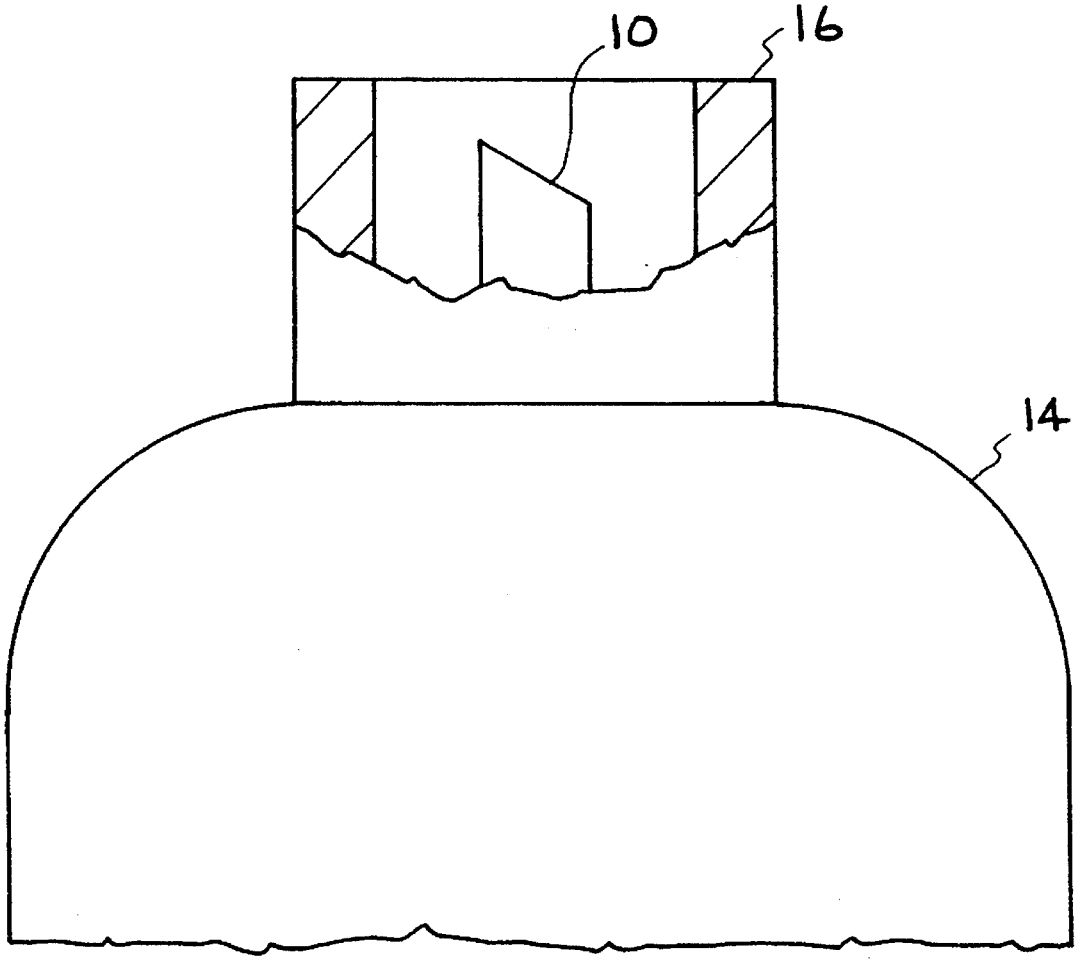
FIG. 4 shows a vessel that has been sealed by crimping a tube below a fixed surface.

In contrast to conventional methods, tube crimping below a fixed surface requires a die and anvil configuration that is not symmetric. FIG. 3 depicts one die and anvil configuration for crimping below a fixed surface. Ductile metal tube 10 and valve assembly 12 are attached to pressure vessel 14, which has a fixed surface 16 around the base of tube 10 at pressure vessel 14. Anvil 18 is flat and placed against tube 10. Die guide 20 is placed against tube 10 on a side opposite anvil 18. Pinch-off die 22 is inserted into die guide 20 against tube 10. Die guide 20 is oriented so that die 22 is directed at an angle to tube 10, with the contact point below surface 16. Adequate clearance for inserting the die and anvil around the tube is needed below the fixed surface. The anvil must be flat so that, after crimping, it may be removed without deforming the crimped tubes. FIG. 4 shows vessel 14 with tube 10 crimped below fixed surface 16.

Figure 5A:
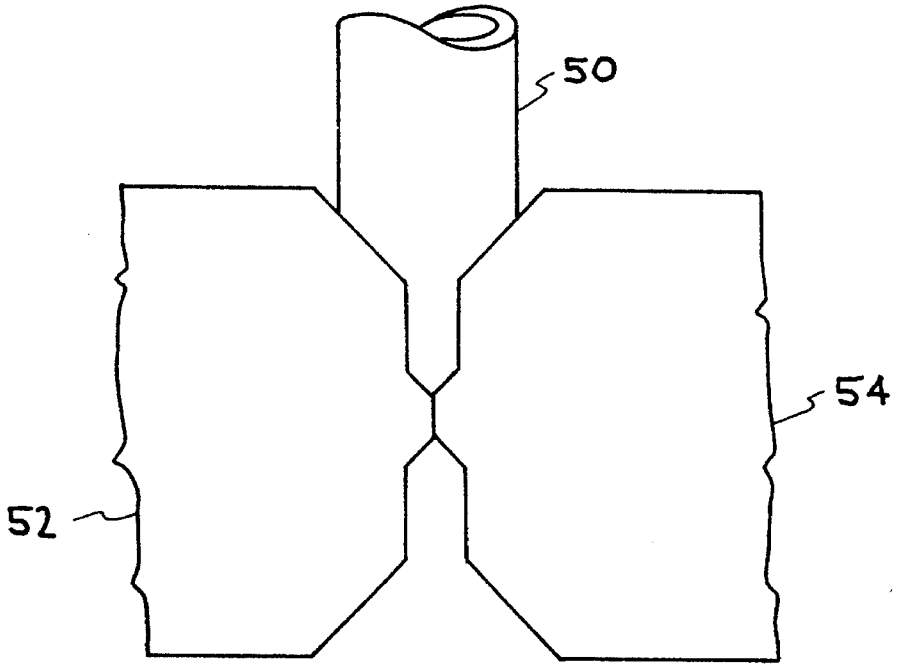
FIG. 5A (PRIOR ART)

The largest difference between the conventional crimping method and crimping below a fixed surface is the angle at which the die contacts the tube. FIG. 5*a* shows a conventional symmetric tube crimping configuration. Tube 50 is crimped above a fixed surface on a pressure vessel. An equal force is exerted by symmetric dies 52 and 54, both having blunt tips. This angle results in large components of shear and tensile stress in sections of the tube which would otherwise be in nearly pure compression. The shear stress improves the quality of the seal. However, the tensile stress causes stretching in the portion of the tube that is to be removed if the tube is not allowed to move with the die. If the tube stretches, it will have a reduction in cross sectional area which results in a reduction of the amount of compression on the tube.

Figure 5B:
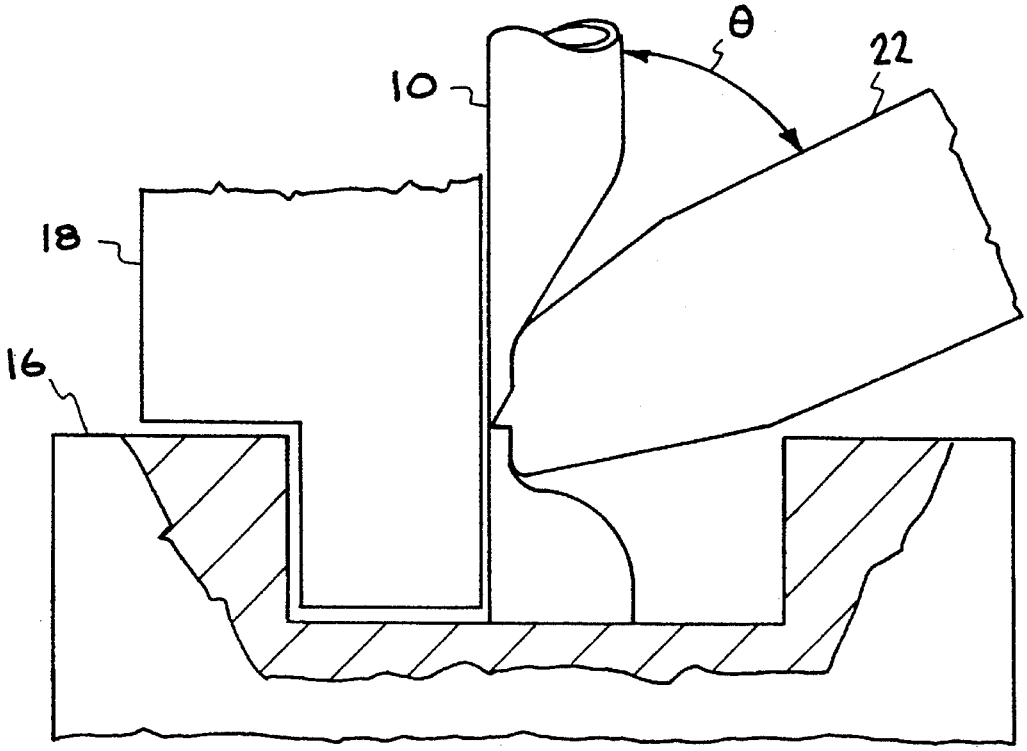

Referring now to FIG. 5*b*, anvil 18 has a flat surface placed adjacent to tube 10. Anvil 18 extends into the clearance area beneath fixed surface 16. Die 22 is positioned at an angle θ (for example, 65 degrees) with respect to tube 10. Another important feature of the crimp tool design is the blunt tip and smooth edges of the die. The smooth edges should be rounded as shown in FIG. 5*b*. The blunt tip may have a slight radius or a short flat section on the leading edge of the die. The reason for the blunt tip is to avoid shearing and rupturing the tube while it is being crimped.

Unless the internal tube surface is free of contamination, the amount of compression that is forced on the tube is the most important factor governing the quality of the seal that is obtained by crimping. The most important features which control the amount of compression placed on the tube are the die gap width and the tube wall thickness, assuming that sufficient force may be applied to cause the tube to sever. For example, a die that is used to compress a tube with a 1/16 inch wall thickness into a gap width of 1/16 inch provides a compression ratio of 2:1 since the two wall thicknesses of tube are compressed to the width of one original wall thickness. A compression ratio of 2:1 would probably be more than enough to create a good seal in a copper tube with a clean internal surface that is free of oxides. However, if the tube is made of stainless steel or if any contamination of the internal tube surface exists, there will be a need for excessive compression to cause the clean metal tube material to flow into contact with clean metal on the opposite side of the tube and create the cohesive seal.

For experimental purposes when developing the present invention, a leak-tight, reliable seal existed when, during the crimp operation and after severing, the tube would contain helium gas at an internal pressure of 150 psig without leaking in excess of $10^{-5}$ std. atm cc/sec. This criterion was based on requirements for protecting personnel from leakage of potentially hazardous materials that would be contained in a pressure vessel. This criterion was used throughout the development tests to validate the results. Furthermore, metallurgical cross sections of numerous samples were prepared in order to observe the extent of the cohesive joint that created the seals.

Experiments have shown that a copper tube with an outer diameter of 1/8 inch and a wall thickness of 0.021 inch can be sealed using a die gap width of 0.027 inch, which provided a compression ratio of approximately 1.5. Good seals were obtained with this configuration at temperatures of −30, 25, and 54 degrees centigrade. Tubes crimped at cold temperature required significantly more work to sever than tubes crimped at higher temperature. Tests were also performed with the tubes filled with helium gas at 180 psig. A helium leak detector was used to inspect for leaks before, during and after the crimp operations.

The force was applied to the die 30 (FIG. 6) using a 1/2 inch diameter twenty threads per inch screw 31 in screw mechanism 32. The maximum applied torque was 400 inch-lbs, which resulted in a compressive force of approximately 700 lbs. When screw 31 is turned against die 30, tubes 35 and 36, which are held in place by anvil 37, are crimped below fixed surface 38. Although this force is much more than enough to crimp the tube, it was found that very high loads were required to accommodate slight imperfections in the die/anvil alignment to cause the tube to sever.

All of the tubes crimped in these experiments were fully annealed due to the brazing process that was used to attach the tubes to the vessels. Stainless steel (alloy 304) was found to be the most difficult to seal of the three materials tested, requiring a compression ratio as large as 3.4. A nickel alloy that is slightly softer than stainless steel gave better results and oxygen free high purity copper was found to give the best results. For corrosion protection, some of the copper tubes tested were plated externally with nickel. The nickel plating showed no effect on the ability to obtain a good seal with copper tubes.

Some of the tubes crimped were welded and drawn, while others were seamless. No difference in seal performance was noted between these two types of tubing. All of the tubes had rough internal surfaces as a result of these forming processes. Excellent results were achieved when the internal tube surfaces were free of contamination. However, when tests were performed on tubes that were loaded with contaminants, such as powdered metal and oxides, only heavy walled copper tubes gave consistently satisfactory results.

For the particular case in which this technique was developed, the objective was to crimp and seal two different size tubes simultaneously, flush or below a fixed surface. FIG. 7 shows a top view of a double tube crimp where tubes 60 and 61 are different sizes. Since the tubes were different sizes, both the anvil 62 and the die 64 have slanted faces so each would be adjacent to both tubes. It was found that both tubes could be sealed in this configuration, provided that both tubes had the same wall thickness which was compatible with the die gap width.

Crimping tubes has proven to be a very useful method for closing pressure vessels with a leak tight metal seal. This method is particularly useful when working with vessels that contain potentially hazardous materials, or in the vicinity of flammable materials. Furthermore, it has been shown that crimping a tube flush or below a fixed surface can be achieved to eliminate some of the problems associated with the crimped tube remnant that remains with the vessel after closure.

Changes and modifications in the specifically described embodiments can be carried out without departing from the scope of the invention, which is intended to be limited by the scope of the appended claims.

We claim:

1. A tube sealing apparatus comprising:

a pressure vessel having ductile metal tubes to be sealed attached thereto, wherein said pressure vessel has a fixed surface surrounding the base of said tube at said pressure vessel;

an anvil for placement against said tubes to be sealed, wherein said anvil is slanted for simultaneous sealing of multiple said tubes, said anvil being slanted relative to the tubes in a plane extending transverse to the tube axes such that a surface of said anvil contacting said tubes extends nonparallel with a line extending through the centers of the tubes in said plane;

a die guide located on a side of said tubes that is opposite from said anvil; and a pinch-off die inserted into said die guide, wherein said pinch-off die is positioned at an angle less than 90 degrees with respect to the axes of said tubes to be sealed, wherein said die guide is configured so that said pinch-off die contacts said base of said tubes below said fixed surface surrounded by said pressure vessel.

2. The apparatus of claim 1, wherein said anvil comprises a flat portion that is placed against said tube to be sealed.

3. The apparatus of claim 1, wherein said angle is 65 degrees.

4. The apparatus of claim 1, wherein said die has a blunt tip.

5. The apparatus of claim 4, wherein said die tip has smooth edges.

6. The apparatus of claim 5, wherein said smooth edges have a slight radius.

7. The apparatus of claim 1, further comprising a die screw mechanism positioned in the die guide for applying force to said pinch-off die.

8. The apparatus of claim 7, wherein-said die screw mechanism comprises a 20 threads per inch, ½ inch diameter screw.

* * * * *